US011767743B2

(12) United States Patent
Lerohl et al.

(10) Patent No.: US 11,767,743 B2
(45) Date of Patent: Sep. 26, 2023

(54) DISTRIBUTED FLUID INJECTION SYSTEM FOR WELLBORES

(71) Applicants: David Lerohl, Houston, TX (US); Pavel Nazarenko, Houston, TX (US); Kevin Holmes, Houston, TX (US); John Raggio, Spring, TX (US)

(72) Inventors: David Lerohl, Houston, TX (US); Pavel Nazarenko, Houston, TX (US); Kevin Holmes, Houston, TX (US); John Raggio, Spring, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 9 days.

(21) Appl. No.: 16/523,063

(22) Filed: Jul. 26, 2019

(65) Prior Publication Data

US 2020/0032632 A1 Jan. 30, 2020

Related U.S. Application Data

(60) Provisional application No. 62/711,027, filed on Jul. 27, 2018.

(51) Int. Cl.

| | |
|---|---|
| ***E21B 43/16*** | (2006.01) |
| ***E21B 43/12*** | (2006.01) |
| *E21B 41/00* | (2006.01) |
| *E21B 43/26* | (2006.01) |

(52) U.S. Cl.

CPC ..... *E21B 43/16* (2013.01); *E21B 43/128* (2013.01)

(58) Field of Classification Search

None

See application file for complete search history.

(56) References Cited

U.S. PATENT DOCUMENTS 5,706,892 A * 1/1998 Aeschbacher, Jr. ..... E21B 34/06 166/66
6,192,983 B1 * 2/2001 Neuroth ..... E21B 43/12 166/250.15

(Continued)

FOREIGN PATENT DOCUMENTS

CN 101338663 A 1/2009
CN 202108493 U 1/2012

(Continued)

OTHER PUBLICATIONS

International Search Report and Written Opinion for International Application No. PCT/US2019/042504; International Filing Date Jul. 19, 2019; Report dated Nov. 7, 2019 (pp. 1-10).

*Primary Examiner* — Matthew Troutman
*Assistant Examiner* — Douglas S Wood
(74) *Attorney, Agent, or Firm* — CANTOR COLBURN LLP

(57) ABSTRACT

A downhole fluid injection system comprising: a first fluid line including a first end, a second end, and an intermediate portion, the first end being connected to a fluid source, the first fluid line being extendable along a first portion of a wellbore; and a second fluid line including a first end section, a second end section, and an intermediate section, the second fluid line being extendable along a second portion of the wellbore that extends at an angle relative to the first portion and includes a plurality of fluid injectors arranged along the intermediate section.

12 Claims, 2 Drawing Sheets

(56) References Cited

U.S. PATENT DOCUMENTS

| | | | | |
|---|---|---|---|---|
| 7,373,974 | B2 * | 5/2008 | Connell | E21B 17/06 166/242.6 |
| 7,861,770 | B2 | 1/2011 | Ascanio Milano | |
| 8,210,257 | B2 | 7/2012 | Dusterhoft | |
| 10,240,633 | B2 * | 3/2019 | Semple | F16C 33/128 |
| 10,648,249 | B2 * | 5/2020 | Varkey | E21B 19/08 |
| 10,961,835 | B2 * | 3/2021 | Mazrooee | E21B 43/267 |
| 11,208,876 | B2 * | 12/2021 | Eslinger | E21B 43/121 |
| 2006/0113083 | A1 | 6/2006 | Connell | |
| 2009/0025940 | A1 * | 1/2009 | Rytlewski | E21B 17/06 166/85.1 |
| 2010/0108313 | A1 | 5/2010 | Chan et al. | |
| 2013/0220618 | A1 | 8/2013 | Pollard | |
| 2013/0223935 | A1 | 8/2013 | Hoier et al. | |
| 2014/0027109 | A1 | 1/2014 | Al-Buraik | |
| 2014/0102708 | A1 * | 4/2014 | Purkis | E21B 43/26 166/308.1 |
| 2015/0176385 | A1 | 6/2015 | Castillo | |
| 2015/0345270 | A1 * | 12/2015 | Elliott | E21B 43/20 166/272.3 |
| 2016/0319607 | A1 * | 11/2016 | Maclean | E21B 19/22 |
| 2018/0320454 | A1 * | 11/2018 | Cochran | E21B 33/0407 |
| 2021/0079773 | A1 | 3/2021 | MacPhail | |

FOREIGN PATENT DOCUMENTS

| | | | |
|---|---|---|---|
| CN | 103643931 | A | 3/2014 |
| CN | 104278979 | A | 1/2015 |
| CN | 104563997 | A | 4/2015 |
| CN | 104632172 | A | 5/2015 |
| CN | 105672972 | A | 6/2016 |
| CN | 205349316 | U | 6/2016 |
| WO | 2017035370 | A1 | 3/2017 |
| WO | 2018126106 | A1 | 7/2018 |

* cited by examiner

DISTRIBUTED FLUID INJECTION SYSTEM FOR WELLBORES

CROSS-REFERENCE TO RELATED APPLICATIONS

This application claims the benefit of an earlier filing date from U.S. Provisional Application No. 62/711,027 filed Jul. 27, 2018, the entire disclosure of which is incorporated herein by reference.

BACKGROUND

In the resource exploration and recovery industry, boreholes may be formed with horizontal sections. One or more horizontal sections may extend from a main bore into a formation. It may be desirable to inject selected chemicals into the horizontal sections to improve production. The chemicals enhance production by improving various characteristics of the formation fluids being produced. The chemicals are injected through a fluid injection system that is introduced into the horizontal section.

The fluid injection system may be run into the horizontal sections with production tubing. A point of injection may arranged at a heel portion of the horizontal section. Location at the heel reduces issues when withdrawing the injection system from the section. While adequate for shorter sections, injection at the heel may not be sufficient for longer horizontal sections.

For longer horizontal sections, the chemicals may not treat large portions of the formation fluids. The untreated fluids may cause issues with the production tubing that could result in multiple clean out operations may be needed while producing the formation fluids. Accordingly, the art would appreciate a system that would promote chemical injection along horizontal wellbore sections.

SUMMARY

Disclosed is a downhole fluid injection system comprising: a first fluid line including a first end, a second end, and an intermediate portion, the first end being connected to a fluid source, the first fluid line being extendable along a first portion of a wellbore; and a second fluid line including a first end section, a second end section, and an intermediate section, the second fluid line being extendable along a second portion of the wellbore that extends at an angle relative to the first portion and includes a plurality of fluid injectors arranged along the intermediate section.

Also disclosed is a resource exploration and recovery system comprising: a surface system including a fluid source; a subterranean system including a casing tubular extending into a wellbore of a formation, the wellbore including a horizontal section including a toe portion and a heel portion; and a fluid injection system extending into the second system from the first system, the fluid injection system comprising: a first fluid line including a first end, a second end, and an intermediate portion, the first end connected to the fluid source; and a second fluid line including a first end section, a second end section, and an intermediate section, the second fluid line extending along the horizontal portion and includes a plurality of fluid injectors arranged along the intermediate section.

Further disclosed is a method of injecting fluids into a horizontal section of a wellbore comprising: introducing a fluid injection system into the wellbore; guiding a portion of the fluid injection system into the horizontal section of the wellbore; and injecting a fluid through a plurality of fluid injectors arranged along the portion of the fluid injection system.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
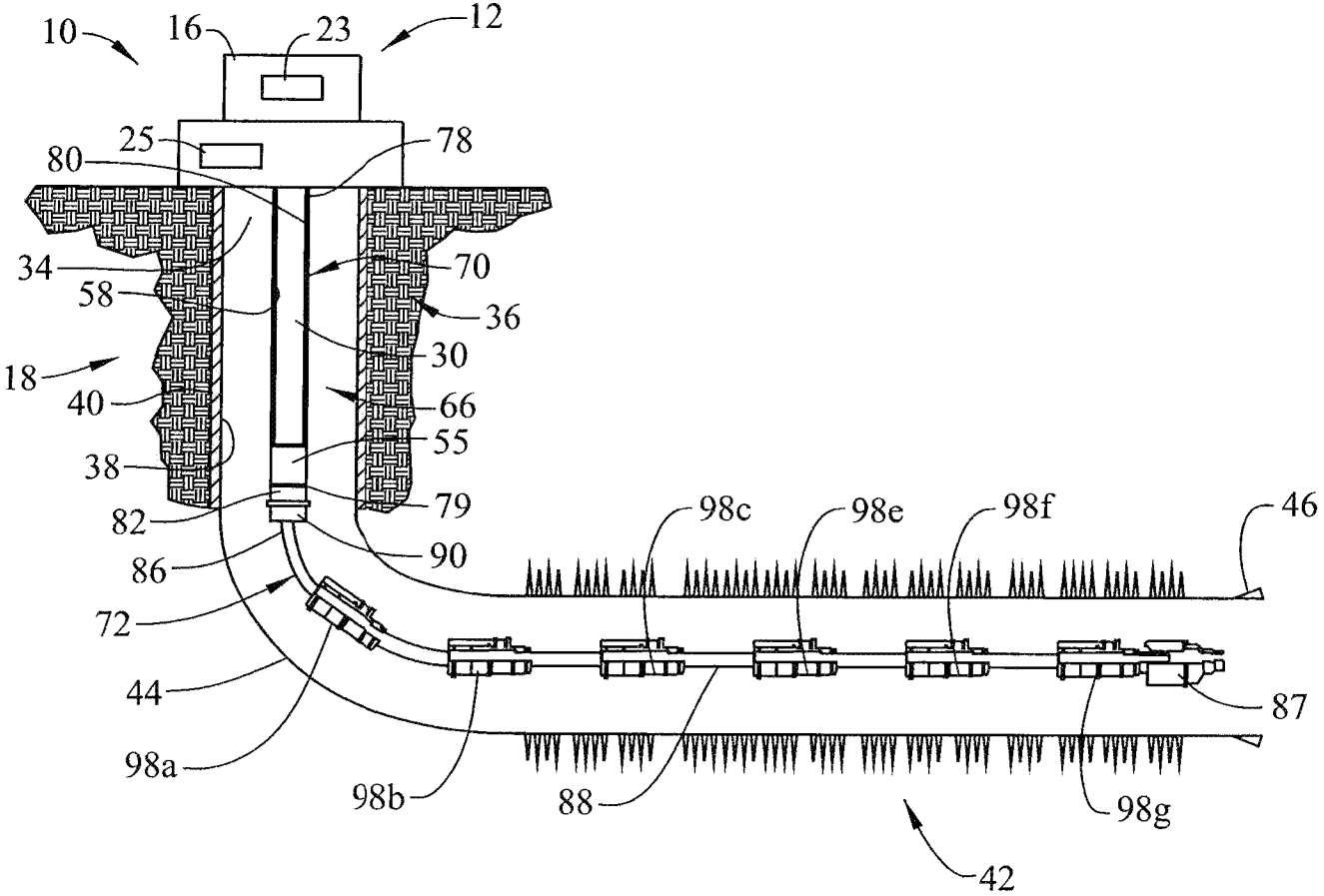
FIG. 1 depicts a resource exploration and recovery system including a distributed fluid injection system, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a downhole system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a tubular 30 that may be formed by one or more tubulars or, in an embodiment, by coil tubing.

Tubular 30 extends extend into a wellbore 34 formed in formation 36. Wellbore 34 includes an annular wall 38, a portion of which may be defined by a casing tubular 40 such as shown. Another portion of wellbore 34 (not separately labeled) may be formed by a surface of formation 36. Formation 36 includes a horizontal section 42 having a heel portion 44 and a toe portion 46. Tubular 30 may support an electric submersible pump (ESP) 55 connected to control system 23 through an ESP cable 58.

Figure 2:
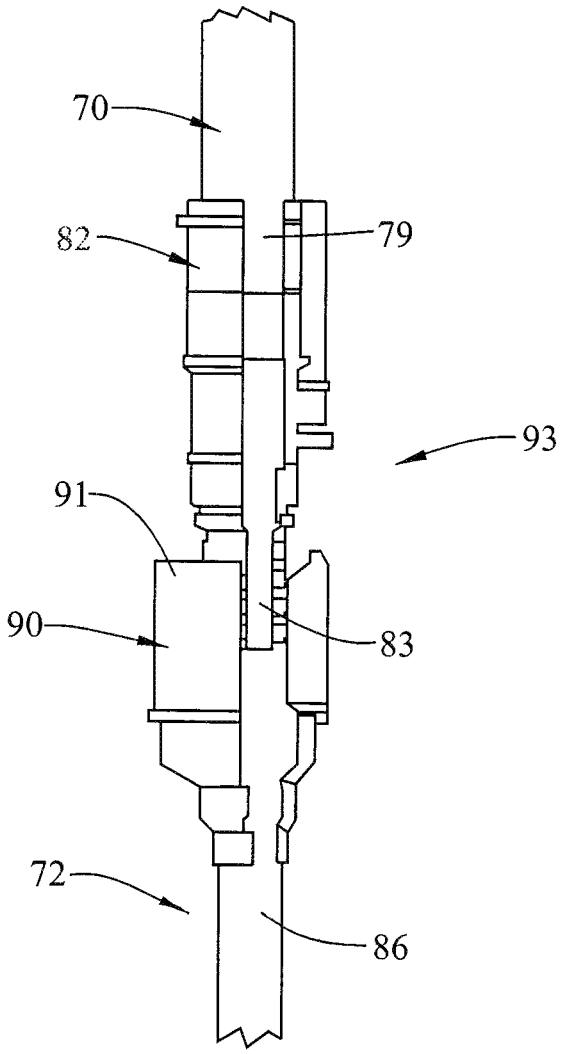
FIG. 2 depicts a connector mechanism for the distributed fluid injection system, in accordance with an aspect of an exemplary embodiment.

In an embodiment, a fluid injection system 66 extends into wellbore 34 with tubular 30. Fluid injection system 66 may introduce select fluids into wellbore 34 to enhance various properties of formation fluids to, for example, improve production. Fluid injection system 66 includes a first fluid line 70 and a second fluid line 72. First fluid line 70 includes a first end 78 that may be connected to fluid source 25, a second end 79, and an intermediate portion 80. Second end 79 includes a first connector portion 82. As shown in FIG. 2, first connector portion 82 may define a male connector portion 83.

Second fluid line 72 includes a first end section 86, a second end section 87 and an intermediate section 88. First end section 86 supports a second connector portion 90 which, as shown in FIG. 2, takes the form of a female connector 91 defining a socket (not separately labeled) receptive of first connector portion 82. First and second connector portions 82 and 90 come together to form a fluid connector 93 that may serve as a crossover. In an embodiment, second fluid line 72 may take the form of coil tubing. In another embodiment, second fluid line 72 may take the form of "stick pipe" defined by a plurality of discrete tubing segments. In an embodiment, intermediate section 88 supports a plurality of fluid injectors 98*a*-98*g*. Fluid injectors 98*a*-98*g* introduce a fluid into horizontal section 42 to improve production. Of course, it should be understood that fluid injectors 98*a*-98*g* may be employed to introduce a variety of fluids into wellbore 34 and not just those chemicals designed to improve production.

In an embodiment, fluid injection system 66 is run into wellbore 34. First fluid line 70 may terminate below ESP 55 at first connector portion 82. Second fluid line 72 extends into horizontal section 42 from heel portion 44 to toe portion 46. Fluid may be introduced from first system 12 and guided downhole by, for example, ESP 55. The fluid passes from first fluid line 70, through connector 93, and into second fluid line 72.

The fluid may be selectively introduced into horizontal section 42 via one or more of fluid injectors 98*a*-98*g*. The fluid may treat formation fluids flowing through horizontal section 42 or formation 36. At some point, it may be desirable to service components arranged uphole of fluid injectors 98*a*-98*g*. For example, it may be desirable to serve of replace ESP 55. At such a time, fluid injection system 66 may be withdrawn from wellbore 34. In one embodiment, first fluid line 70 may be disconnected from second fluid line 72 at connector 93. At this point, first fluid line 70 together with ESP 55 may be brought out of wellbore 34. Second fluid line 72 may be left in horizontal section 42. After servicing ESP 55, first fluid line 70 may be run back into wellbore 34 and connected with second fluid line 72.

At this point it should be understood that the exemplary embodiments describe a system that allows fluid treatment of horizontal sections of a wellbore from a heel portion all the way to a toe portion. Fluid injectors may be arranged in a spaced relationship that allows for a desirable fluid distribution into the formation. Further, a connector is provided that allows a portion of the fluid injection system to be withdrawn from the wellbore while leaving another section behind. In this manner, in the event that a portion of the system becomes snagged or hung up, upper portions of the system may be withdrawn.

Set forth below are some embodiments of the foregoing disclosure:

Embodiment 1

A downhole fluid injection system including: a first fluid line including a first end, a second end, and an intermediate portion, the first end being connected to a fluid source, the first fluid line being extendable along a first portion of a wellbore; and a second fluid line including a first end section, a second end section, and an intermediate section, the second fluid line being extendable along a second portion of the wellbore that extends at an angle relative to the first portion and includes a plurality of fluid injectors arranged along the intermediate section.

Embodiment 2

The fluid injection system as in any prior embodiment, wherein the second fluid line comprises a length of coil tubing.

Embodiment 3

The fluid injection system as in any prior embodiment, wherein the second fluid line comprises a plurality of discrete tubing segments coupled though one or more connectors, the plurality of fluid injectors being arranged in one or more of the plurality of discrete tubing segments.

Embodiment 4

The fluid injection system as in any prior embodiment, further comprising: an electric submersible pump (ESP) coupled to the first fluid line.

Embodiment 5

The fluid injection system according to any prior embodiment, wherein the ESP is arranged uphole of the first connector portion.

Embodiment 6

The fluid injection system as in any prior embodiment, wherein the second end of the first fluid line includes a first connector portion and the first end of the second fluid line includes a second connector portion, the first connector portion being selectively connected to the second connector portion to fluidically connect the first fluid line and the second fluid line.

Embodiment 7

A resource exploration and recovery system including: a surface system including a fluid source; a subterranean system including a casing tubular extending into a wellbore of a formation, the wellbore including a horizontal section including a toe portion and a heel portion; and a fluid injection system extending into the second system from the first system, the fluid injection system including: a first fluid line including a first end, a second end, and an intermediate portion, the first end connected to the fluid source; and a second fluid line including a first end section, a second end section, and an intermediate section, the second fluid line extending along the horizontal portion and includes a plurality of fluid injectors arranged along the intermediate section.

Embodiment 8

The resource exploration and recovery system as any prior embodiment, wherein the second fluid line comprises a length of coil tubing.

Embodiment 9

The resource exploration and recovery system as any prior embodiment, wherein the second fluid line comprises a plurality of discrete tubing segments coupled though one or more connectors, the plurality of fluid injectors being arranged in one or more of the plurality of discrete tubing segments.

Embodiment 10

The resource exploration and recovery system as in any prior embodiment, further comprising: an electric submersible pump (ESP) coupled to the first fluid line.

Embodiment 11

The resource exploration and recovery system as in any prior embodiment, wherein the ESP is arranged uphole of the first connector portion.

Embodiment 12

The resource exploration and recovery system as in any prior embodiment, wherein the first connector portion is coupled to the second connector portion uphole of the heel portion.

Embodiment 13

The resource exploration and recovery system as in any prior embodiment, at least one of the plurality of fluid injectors is arranged at the toe portion of the horizontal section.

Embodiment 14

The resource exploration and recovery system as in any prior embodiment, wherein the second end of the first fluid line includes a first connector portion and the first end of the second fluid line includes a second connector portion, the first connector portion being selectively connected to the second connector portion to fluidically connect the first fluid line and the second fluid line.

Embodiment 15

A method of injecting fluids into a horizontal section of a wellbore including: introducing a fluid injection system into the wellbore; guiding a portion of the fluid injection system into the horizontal section of the wellbore; and injecting a fluid through a plurality of fluid injectors arranged along the portion of the fluid injection system.

Embodiment 16

The method as in any prior embodiment, wherein injecting the fluid includes introducing fluid into the toe portion of the horizontal section.

Embodiment 17

The method as in any prior embodiment, further comprising: disconnecting a connector coupled to the portion of the fluid injection system in the horizontal section; and withdrawing the remaining portion of the fluid injection system from the wellbore.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole fluid injection system comprising:

a first fluid line including a first end, a second end, and an intermediate portion, the first end being connected to a fluid source, the first fluid line being extendable along a first portion of a wellbore, the second end of the first fluid line including a first connector portion;

an electric submersible pump (ESP) coupled to the first fluid line and arranged uphole of the first connector portion; and a second fluid line including a first end section, a second end section, and an intermediate section, the second fluid line being extendable along a second portion of the wellbore that extends at an angle relative to the first portion and includes a plurality of fluidically connected fluid injectors arranged along the intermediate section, the first fluid line and the second fluid line being run into the wellbore with the ESP to perform wellbore operations, the first end section of the second fluid line including a second connector portion, the first connector portion of the first fluid line being selectively disconnectable from the second connector portion of the second fluid line allowing the first fluid line and the ESP to be withdrawn from the wellbore while the second fluid line and the plurality of fluidically connected fluid injectors remain downhole, the first connector portion being selectively reconnectable to the second connector portion of the second fluid line to continue wellbore operations after being withdrawn.

2. The fluid injection system according to claim 1, wherein the second fluid line comprises a length of coil tubing.

3. The fluid injection system according to claim 1, wherein the second fluid line comprises a plurality of discrete tubing segments coupled through one or more connectors, the plurality of fluid injectors being arranged in one or more of the plurality of discrete tubing segments.

4. The fluid injection system according to claim 1, wherein the first portion of the wellbore is a vertical section of the wellbore and the second section of the wellbore is a horizontal section of the wellbore, the first and second connector portions being arranged in the vertical section of the wellbore.

5. A resource exploration and recovery system comprising:

a surface system including a fluid source;

a subterranean system including a casing tubular extending into a wellbore of a formation, the wellbore including a vertical section and a horizontal section including a toe portion and a heel portion; and a fluid injection system extending into the second system from the first system, the fluid injection system comprising:

a first fluid line including a first end, a second end, and an intermediate portion, the first end connected to the fluid source, the second end of the first fluid line including a first connector portion;

an electric submersible pump (ESP) coupled to the first fluid line and arranged uphole of the first connector portion; and a second fluid line including a first end section, a second end section, and an intermediate section, the second fluid line extending along the horizontal portion and includes a plurality of fluidically connected fluid injectors arranged along the intermediate section, the first fluid line and the second fluid line being run into the wellbore with the ESP to perform wellbore operations, the first end section of the second fluid line including a second connector portion, the first connector portion of the first fluid line being selectively disconnectable from the second connector portion of the second fluid line allowing the first fluid line and the ESP to be withdrawn from the wellbore while the second fluid line and the plurality of fluidically connected fluid injectors remain downhole, the first connector portion being selectively reconnectable to the second connector portion of the second fluid line to continue wellbore operations after being withdrawn.

6. The resource exploration and recovery system according to claim 5, wherein the second fluid line comprises a length of coil tubing.

7. The resource exploration and recovery system according to claim 5, wherein the second fluid line comprises a plurality of discrete tubing segments coupled though one or more connectors, the plurality of fluid injectors being arranged in one or more of the plurality of discrete tubing segments.

8. The resource exploration and recovery system according to claim 5, wherein the first connector portion is coupled to the second connector portion uphole of the heel portion.

9. The resource exploration and recovery system according to claim 5, at least one of the plurality of fluid injectors is arranged at the toe portion of the horizontal section.

10. The resource exploration and recovery system according to claim 5, wherein the first fluid line and the ESP are positioned in the vertical section of the wellbore.

11. A method of injecting fluids into a horizontal section of a wellbore comprising:

introducing a fluid injection system including an electric submersible pump (ESP) into a vertical section of the wellbore, the ESP being fluidically connected between a first fluid line and a second fluid line;

guiding a portion of the second fluid line of the fluid injection system into the horizontal section of the wellbore;

performing wellbore operations by injecting a fluid through the first fluid line, into the second fluid line and through a plurality of fluidically connected fluid injectors arranged along the portion of the fluid injection system;

disconnecting a connector coupled between the ESP and the second fluid line of the fluid injection system in the horizontal section;

withdrawing the first fluid line and the ESP from the wellbore;

re-introducing the first fluid line and the ESP into the wellbore; and re-connecting the connector joining the ESP with the second fluid line to commence further wellbore operations.

12. The method of claim 11, wherein injecting the fluid includes introducing fluid into the toe portion of the horizontal section.

* * * * *